US007146766B2

(12) United States Patent
Finkelstein

(10) Patent No.: US 7,146,766 B2
(45) Date of Patent: Dec. 12, 2006

(54) DOOR CONTROL ASSEMBLY

(75) Inventor: Burl Finkelstein, Newnan, GA (US)

(73) Assignee: Manitowoc Foodservice Companies, Inc.

( * ) Notice: Subject to any disclaimer, the term of this patent is extended or adjusted under 35 U.S.C. 154(b) by 318 days.

(21) Appl. No.: 10/802,161

(22) Filed: Mar. 16, 2004

(65) Prior Publication Data

US 2005/0206286 A1 Sep. 22, 2005

(51) Int. Cl.
*E05F 11/24* (2006.01)
*E05F 11/00* (2006.01)

(52) U.S. Cl. ..... 49/324; 49/339; 16/84; 292/92

(58) Field of Classification Search ..... 49/339, 49/340, 345, 356, 381; 16/84, 82, 66, 49, 16/51; 62/449, 440; 312/401, 405; 292/92, 292/21, DIG. 71, DIG. 19; 70/92, 91, 101, 70/102; 109/63.5, 62, 64
See application file for complete search history.

(56) References Cited

U.S. PATENT DOCUMENTS 4,210,349 A * 7/1980 Cook et al. ..... 292/78
5,170,530 A 12/1992 Kopec et al.
5,272,789 A 12/1993 Mitchell et al.
5,437,079 A 8/1995 Park
5,525,880 A * 6/1996 Geringer et al. ..... 318/446
5,687,452 A * 11/1997 Hamatani et al. ..... 16/82
5,946,772 A 9/1999 DeBower
6,167,589 B1 1/2001 Luedtke
6,317,922 B1 11/2001 Kondratuk
6,397,430 B1 6/2002 Brown et al.
6,421,876 B1 7/2002 Ginzel et al.
6,609,400 B1 * 8/2003 Luker ..... 70/92
2002/0133904 A1 9/2002 Donovan et al.

* cited by examiner

*Primary Examiner*—Hugh B. Thompson, II
(74) *Attorney, Agent, or Firm*—Brinks, Hofer, Gilson & Lione

(57) ABSTRACT

A door control assembly for a door closing an opening in a wall of a refrigerated compartment cooperates with an oblique hinge set to provide an opening and closing force on the door. The door control assembly includes a mounting plate attached to the door and a flange attached to a door frame. A fluidic control mechanism is coupled to a reciprocating arm pivotally attached to the mounting plate and is coupled to a ball stud on the door flange. A cable is also attached to the reciprocating arm and to a post on the door flange. The fluidic control mechanism and cable cooperate to exert counterbalancing forces on the door at various door open positions.

46 Claims, 9 Drawing Sheets

DOOR CONTROL ASSEMBLY

TECHNICAL FIELD

The present invention relates, generally, to door control mechanisms and hinge systems for controlling the opening and closing of doors or panels and, more particularly, to door control assemblies for controlling the opening and closing of relatively large and heavy doors closing openings into refrigerated spaces, such as walk-in coolers, refrigerators, food chilling compartments, and the like.

BACKGROUND

Door opening and closing mechanisms typically include spring mechanisms, or pneumatic or hydraulic piston devices. The mechanisms are mounted either between the door frame and a midsection of the door, or between the door frame and the top of the door. For example, door closers used to return storm doors and screen doors to a closed position generally include a cylindrical tube containing a piston and a rod with an end extending from the free end of the tube. The end of the rod is attached to the door frame and the other end of the tube is attached to the door. As the door is opened, the rod is forced out of the tube, which compresses a spring positioned inside the tube. When the door is released, the spring causes the piston to return to its retracted position in the tube, which places a closing force on the door.

Another common door control mechanism mounts to a top edge of the door and is anchored to the top of the door frame. Door control mechanisms located in this position are typically used for large heavy doors found in office buildings, warehouses, schools, and the like. A large oblong metal casing is mounted to the top of the door. Inside the casing, a spring drives a piston that is, in turn, either pneumatically or mechanically damped to control door speed when the door is closing. Opening the door compresses the spring and stores energy in the spring. Releasing the door allows the spring to extend to its uncompressed position, which asserts a closing force on the door.

Door control mechanisms of the type described above tend to be large and bulky devices that detract from the aesthetic appearance of the door to which they are attached. Further, the typical door control mechanisms are designed to work with heavy mechanical door latches. The mechanical door latches typically require considerable closing force to securely latch the door. Accordingly, the door control devices used with mechanical latches apply a large closing force to satisfy the closing force requirements of the mechanical latch. Further, in many cases, the door control mechanisms described above do not exert any opening force upon the door. Separate mechanical systems are used to open doors automatically in situations where opening assistance is required.

Doors that close openings into refrigerated compartments, such as walk-in coolers, refrigerators, food chilling compartments, and the like, are usually large and heavy doors. Doors of this type are often designed to have a width that is sufficient to allow movement of carts, hand trucks, and other cargo transporting devices into and out of refrigerated compartments. To accommodate the size and weight of refrigerated compartment doors, the door closing mechanisms are proportionately large and designed to apply sufficient force to securely latch the door.

With the development of new light-weight, high R factor insulation, high-strength construction materials, commercial refrigerated compartments can now be built and designed with refined features and improved latching mechanisms. For example, doors for commercial refrigerated compartments can now be latched and sealed with magnetic closures. Additional design refinements include contoured handles and refined hinge systems that, in the past, could only be used on lighter weight, smaller doors.

With the continued refinements in refrigerated compartment construction, more active door control systems have been sought in order to improve the ease of door operation. Needed operational improvements include opening assistance and the ability to park the door in a partially-opened position. Further, desired door operation improvements include the ability to exert a controlled amount of force on the door in a wide variety of opened positions, including fully opened at an open angle of 180°. In addition to operational improvement, a need exists for a more compact door control mechanism that does not detract from the aesthetic appearance of the door.

BRIEF SUMMARY

In accordance with the invention, there is provided, in one aspect, a door control assembly for a door closing an opening into a refrigerated compartment. The door control assembly includes a mounting plate attached to the door and a flange attached to a wall of the refrigerated compartment. The flange includes a platform extending away from the wall and a first ball stud and a first post extend from the platform. A reciprocating arm is coupled to the mounting plate and a second ball stud and a second post extend from the reciprocating arm and are oriented generally perpendicular to the reciprocating arm. A control mechanism is pivotally engaged with the first ball stud at a first end and with the second ball stud at a second end and a cable is coupled to the first post at a first end and to the second post at a second end.

In accordance with another embodiment of the invention there is provided a combination of a door closing an opening into a wall of a refrigerated compartment, a hinge set, and a door control assembly. The door control assembly includes a mounting plate attached to the door and a flange attached to a door frame of the refrigerated compartment. A door control mechanism has a first end attached to the flange and a second end attached to the mounting plate. A cover is attached to the mounting plate and overlies the first end of the door control mechanism. The cover has a canopy cantilevered over the flange and encloses the first end of the door control mechanism against the wall.

In still another embodiment, the invention includes a concealed middle door control assembly that includes a door control mechanism for applying opening and closing force to a door. A mounting plate is positioned behind the control mechanism. The mounting plate has a curved section cantilevered away from the mounting plate. A cover overlies the control mechanism, wherein the cover has a canopy at a first end that cooperates with the curved section to enclose the control mechanism, and wherein the cover is coupled to the mounting plate at a second end.

In yet another embodiment of the invention a refrigerated compartment is provided having a wall and a door positioned within a door frame and closing and opening in the wall. An upper door hinge has a hinge pin displaced a first distance from the wall and a lower door hinge has a hinge pin displaced a second distance from the wall, where the second distance is greater than the first distance. A door control mechanism has a first end attached to the door frame and a second end attached to a midsection of the door. The door control mechanism is configured to exert an opening force when the door is opened by a user and to exert a closing force when the door is closed by a user. A cover conceals the door control mechanism.

In a further embodiment of the invention, a door control assembly is configured to exert an opening and a closing force on a door positioned within a door frame. The door control assembly includes a reciprocating arm coupled to the door and a flange attached to the door frame. A fluidic control mechanism is coupled to the flange at a first end and to the reciprocating arm at a second end and a cable is coupled to the flange at a first end and to the reciprocating arm at a second end.

DETAILED DESCRIPTION

Figure 1:
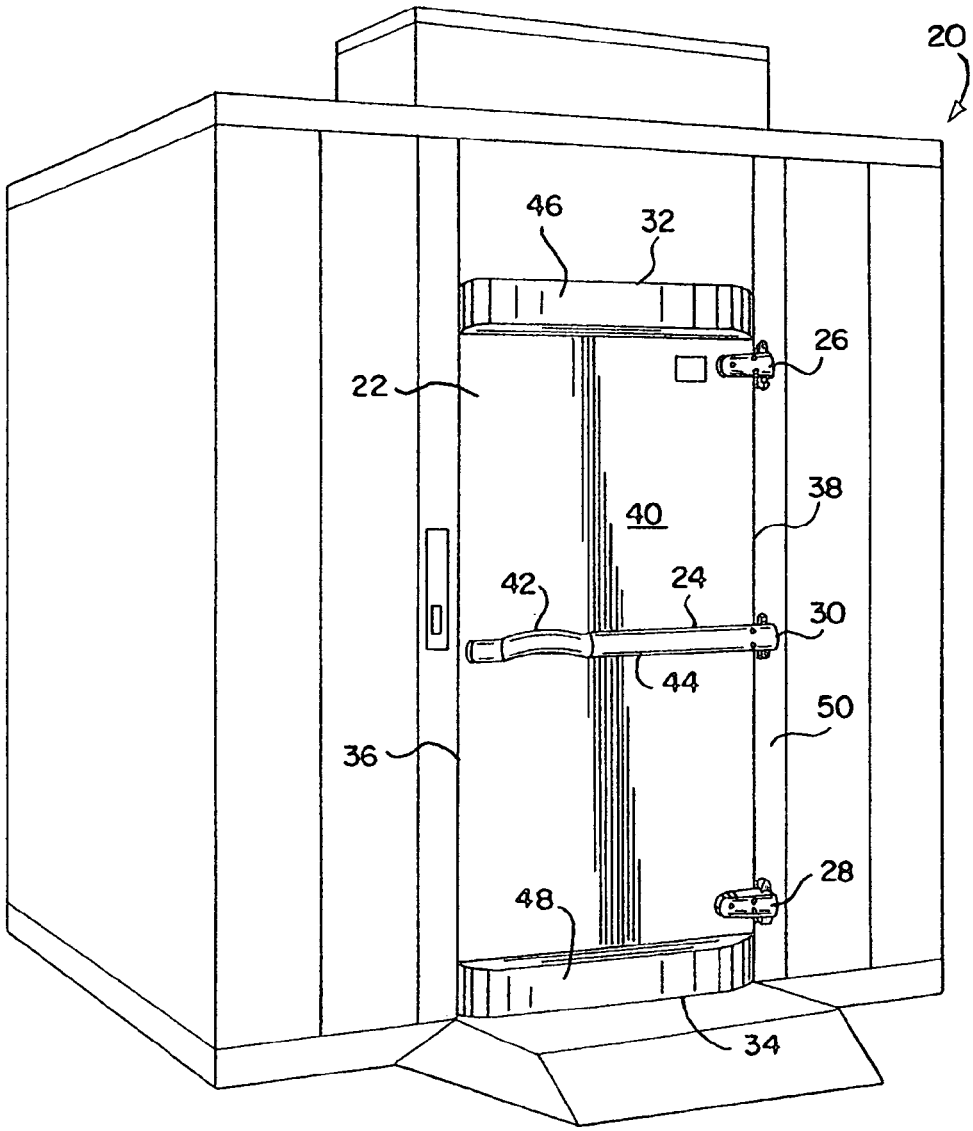
FIG. 1 is a perspective view of a refrigerated compartment having a door closing an opening in a wall of the refrigerated compartment, a hinge set, and a concealed door control assembly configured in accordance with a preferred embodiment of the invention.

FIG. 1 illustrates a perspective view of a refrigerated compartment 20 having a door 22 and a door handle 24. Door 22 closes an opening into refrigerated compartment 20 and is attached to refrigerated compartment 20 by an upper hinge 26 and a lower hinge 28. A concealed door control assembly 30 is positioned at the midpoint of door 22 and is coupled to door handle 24. Door 22 remains closed by magnetic closures (not shown) that keep door 22 sealed against a door jam (not shown).

Door 22 includes a top edge 32, a bottom edge 34, a left edge 36, and a right edge 38. Door handle 24 extends across a face surface 40 of door 22 in a first direction generally parallel with top edge 32 and bottom edge 34. Door handle 24 includes a grip 42 and a handle extension 44 that couples to concealed door control assembly 30. Door 22 also includes an upper door molding 46 and a lower door molding 48. As will subsequently be described, door control assembly 30 provides an opening and closing force on door 22, such that door 22 can be easily opened and closed by a user. Additionally, door control assembly 30 allows door 22 to be parked in a partially open or fully open position to facilitate movement of materials into and out of refrigerated compartment 20. Further, the active control mechanisms of door control assembly 30 are configured so as to be concealed behind a cover that engages handle extension 44. Accordingly, door control assembly 30 provides operating assistance to door 22 while not detracting from the aesthetically-pleasing appearance of door 22. Further, door control assembly 30 can be configured to share common aesthetic design aspects with upper and lower hinges 26 and 28.

Figure 2:
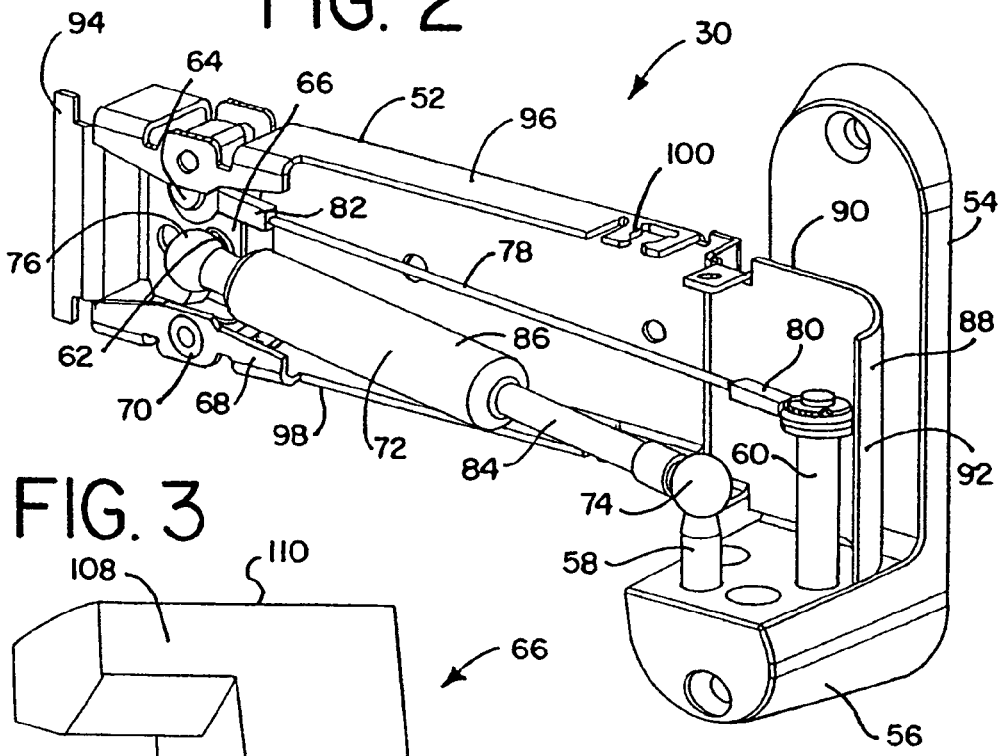
FIG. 2 is a perspective view of the door control assembly of FIG. 1 in a door close position.

A perspective view of door control assembly 30 is illustrated in FIG. 2 in accordance with one embodiment of the invention. Door control assembly 30 includes a mounting plate 52 that attaches to door 22 and a flange 54 that attaches to door frame 50. Flange 54 has a platform 56 that extends from flange 54 in a substantially perpendicular direction from door frame 50. Platform 56 supports first ball stud 58 and a first post 60. First ball stud 58 and first post 60 extend substantially perpendicular to platform 56 and substantially parallel to the side of door frame 50 to which flange 54 is attached. A second ball stud 62 and a second post 64 extend perpendicularly from a reciprocating arm 66. Reciprocating arm 66 is coupled to a lower bracket 68 of mounting plate 52 by a pinned joint 70. During operation of door 22, reciprocating arm 66 pivots back and forth about pinned joint 70.

A fluidic control mechanism 72 has a first end 74 pivotally engaged with first post 58 and a second end 76 pivotally engaged with second post 64. Door control assembly 30 further includes a cable 78 having a first end 80 coupled to first post 60 and a second end 82 coupled to second post 64. As used herein, the term "pivotally" refers to radial movement in all directions. As will subsequently be described, the fluidic control mechanism and the cable are able to move in more than one plane with respect to the flange and the mounting plate as the door is opened and closed.

In the embodiment illustrated in FIG. 2, fluidic control mechanism 72 is engaged with first and second ball studs 58 and 62 by a ball and socket joint. Further, cable 78 is coupled to first post 60 and second post 64 by cable eyelets. Those skilled in the art will, however, appreciate that fluidic control mechanism 72 and cable 78 can be coupled to the ball studs and posts by a variety of different rotatable coupling mechanisms, such as rings, hooks, knuckles, and the like. In a preferred embodiment of the invention, fluidic control mechanism 72 is a pneumatic device, a hydraulic device, or a spring device. In one particular embodiment of the invention, fluidic control mechanism 72 is a gas piston. A piston rod 84 is attached to a piston (not shown) housed within a cylinder 86.

Mounting plate 52 contains several portions that interlock or mate with a cover (shown in FIGS. 9–12) to conceal the functional components of door control assembly 30. Mounting plate 52 has a plate 88 extending between first post 60 and flange 54. Plate 88 is curved so as to partially wrap around first post 60. Plate 88 includes a flat section 90 substantially parallel to door frame 50 and a curved section 92 partially surrounding first ball stud 58 and first post 60.

Mounting plate 52 has a locking tab 94 located at the opposite end of mounting plate 52 from plate 88. As will subsequently be described, locking tab 94 interlocks with handle extension 44.

Mounting plate 52 also includes an upper bracket 96 and a lower bracket 98. Upper bracket 96 and lower bracket 98 contain receiving channels 100 are configured to receive locking pins in the cover that attaches to mounting plate 52.

Figure 3:
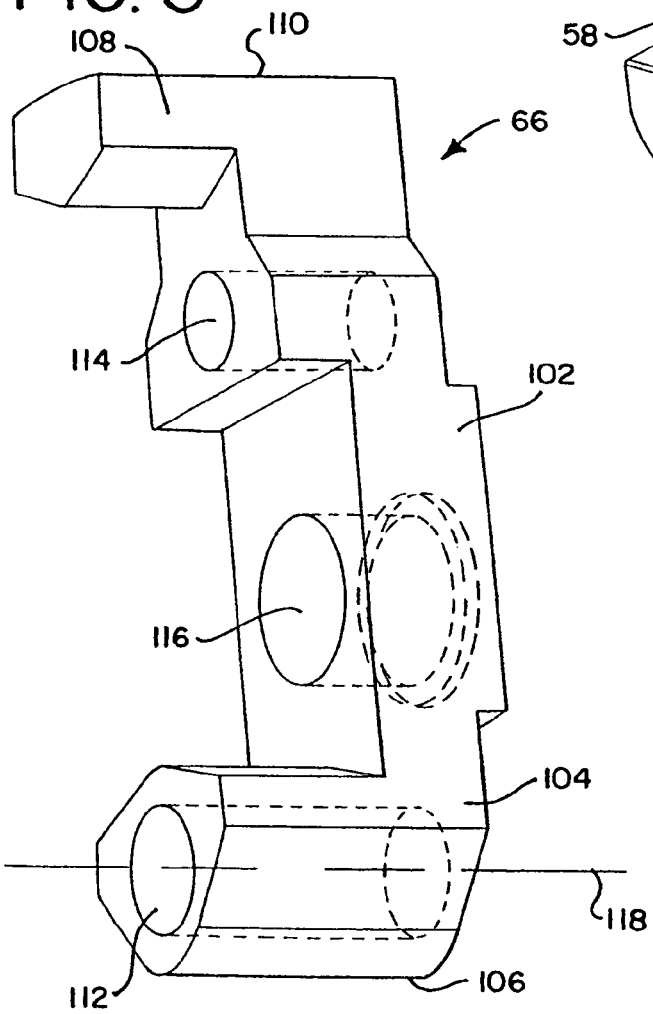
FIG. 3 is a perspective view of a reciprocating arm configured used in the door control assembly of FIG. 2.

A perspective view of reciprocating arm 66 is illustrated in FIG. 3. Reciprocating arm 66 has an elongated body 102 that includes a pin housing 104 at a first end 106 and a loading bar 108 at a second end 110. Pin housing 104 has a bore hole 112 that accommodates a bushing and pin for pinned joint 70. Elongated body 102 also includes a bore hole 114 that accommodates second post 64, and a bore hole 116 that accommodates second ball stud 62. Bore holes 114 and 116 are positioned in elongated body 102 such that rotation about bore hole 112 produces a moment arm about an axis 118 through the center of bore hole 112. Accordingly, the tension on cable 78 and piston 72 changes as door 22 is opened and closed.

Figure 4A:
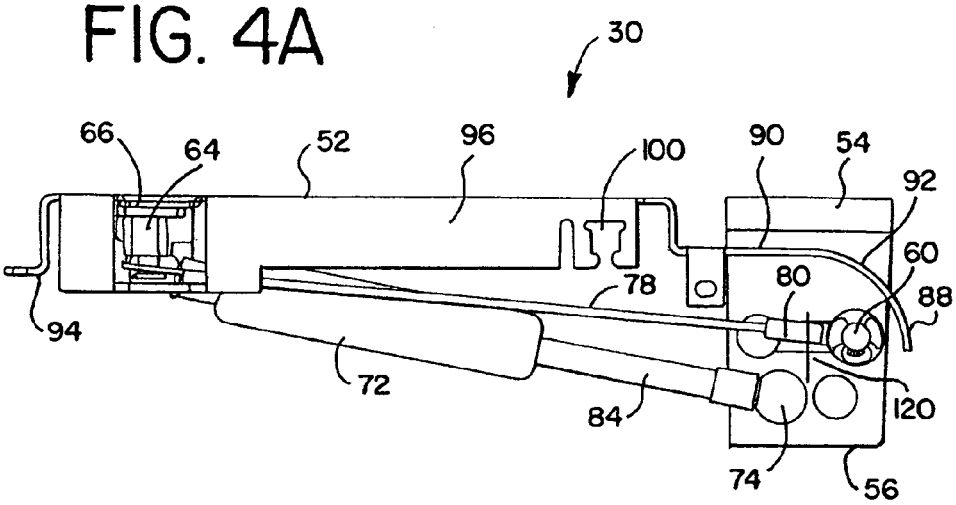
FIG. 4A is a top view of the door control assembly illustrated in FIG. 2.
Figure 4B:
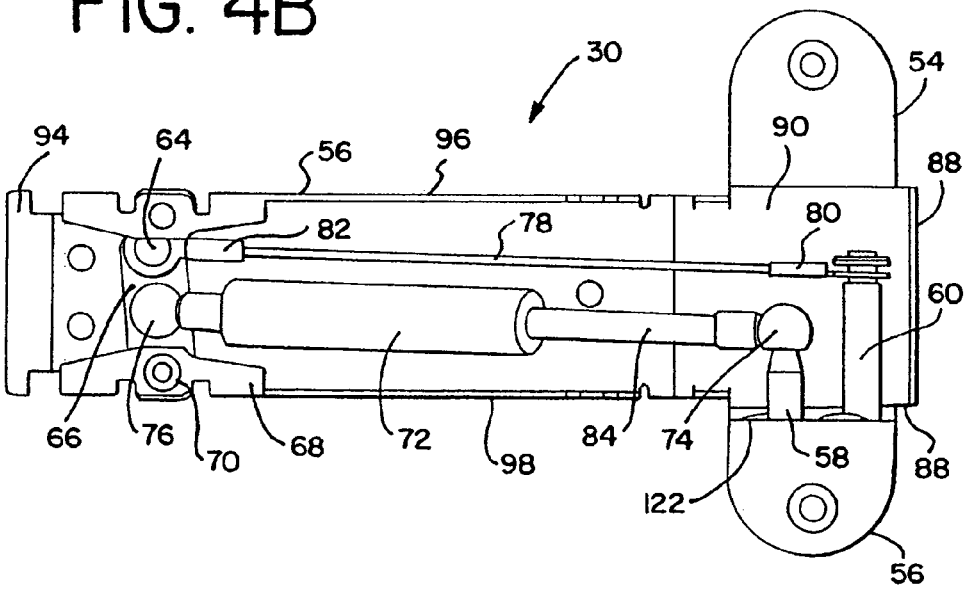
FIG. 4B is a side view of the door control assembly illustrated in FIG. 2.

The operation of door control assembly 30 will now be illustrated through top views and side views of door control assembly 30 in various door open positions. A top view and a side view of door control assembly 30 are illustrated in FIGS. 4A and 4B, respectively. Door control assembly 30 is illustrated in a fully door closed position. For clarity of illustration, in FIGS. 4A and 4B and in subsequent figures, door 22 and door frame 50 are not shown. It will be understood, however, that flange 54 is attached to door frame 50 and mounting plate 52 is attached to door 22.

When door 22 is in a fully closed position, reciprocating arm 66 leans slightly to the left of vertical. Further, a pivot point 120 (shown by crosshairs in FIG. 4A) of door 22 is shown on platform 56. When door 22 is fully closed, cable 78 is positioned between pivot point 120 and flange 54 adjacent to door frame 50. Also, piston rod 84 is opposite pivot point 120 from flange 54. In this position, piston 72 pushes against mount plate 52 to maintain a closing force on door 22.

In a preferred embodiment of the invention, upper and lower hinges 26 and 28 are cam hinges. When door 22 is open, upper and lower hinges 26 and 28 create a slight upward motion of door 22 as they ride on load-bearing cam surfaces. As will subsequently be described, door control assembly 30 is configured to accommodate the camming operation of upper and lower hinges 26 and 28. In the side view of FIG. 4B, when door 22 is closed, plate 88 is in close proximity to an upper surface 122 of platform 56. As door 22 is opened, mounting plate 52 will undergo an upward vertical displacement, while platform 56 and flange 54 remain stationary on door frame 50. Reciprocating arm 66 equalizes the motion of cable 78 and fluidic control mechanism 72 and acts to maintain a dynamic force balance such that door 22 is not pushed or pulled against hinges 26 and 28.

Figure 5A:
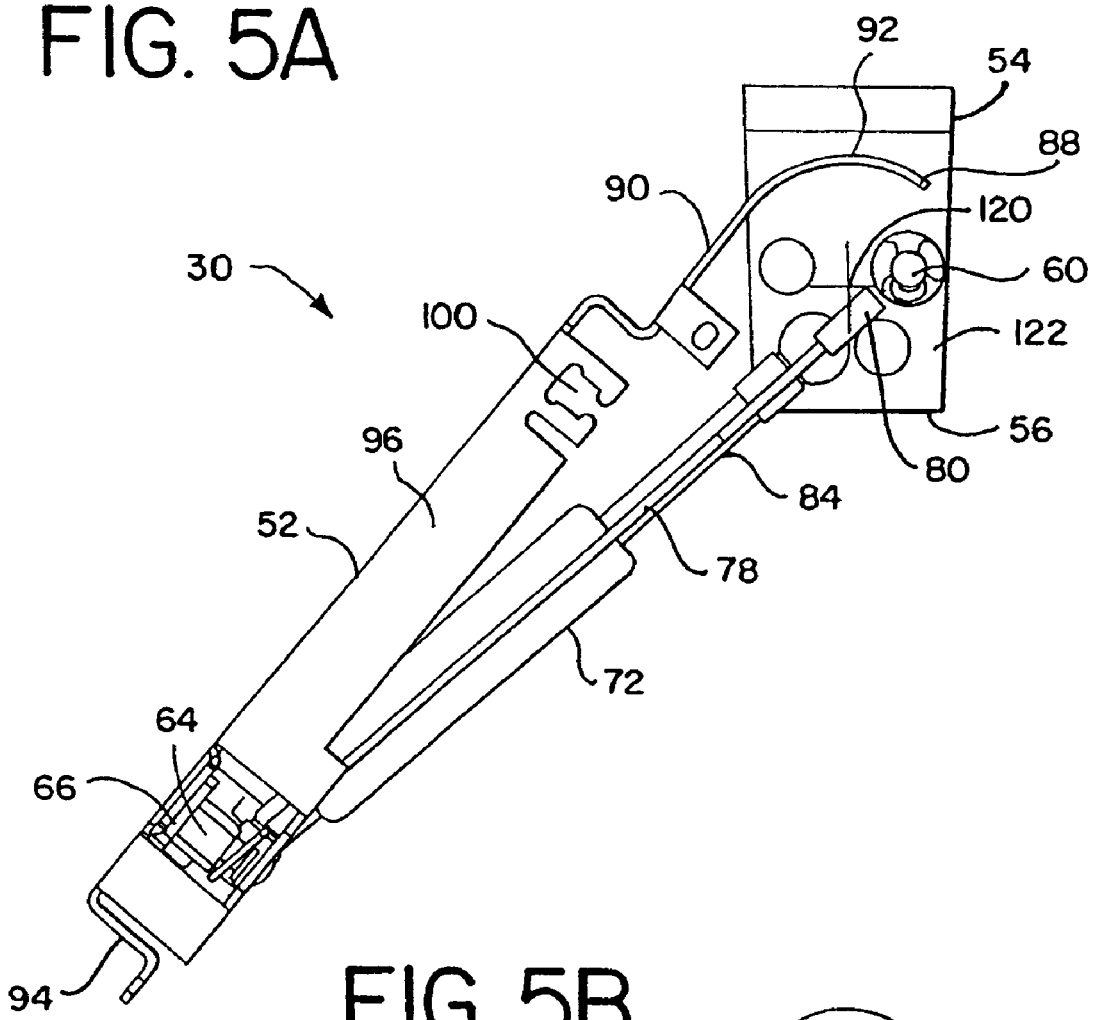
FIG. 5A is a top view of the door control assembly illustrated in FIG. 2 at a door open angle of 45°.
Figure 5B:
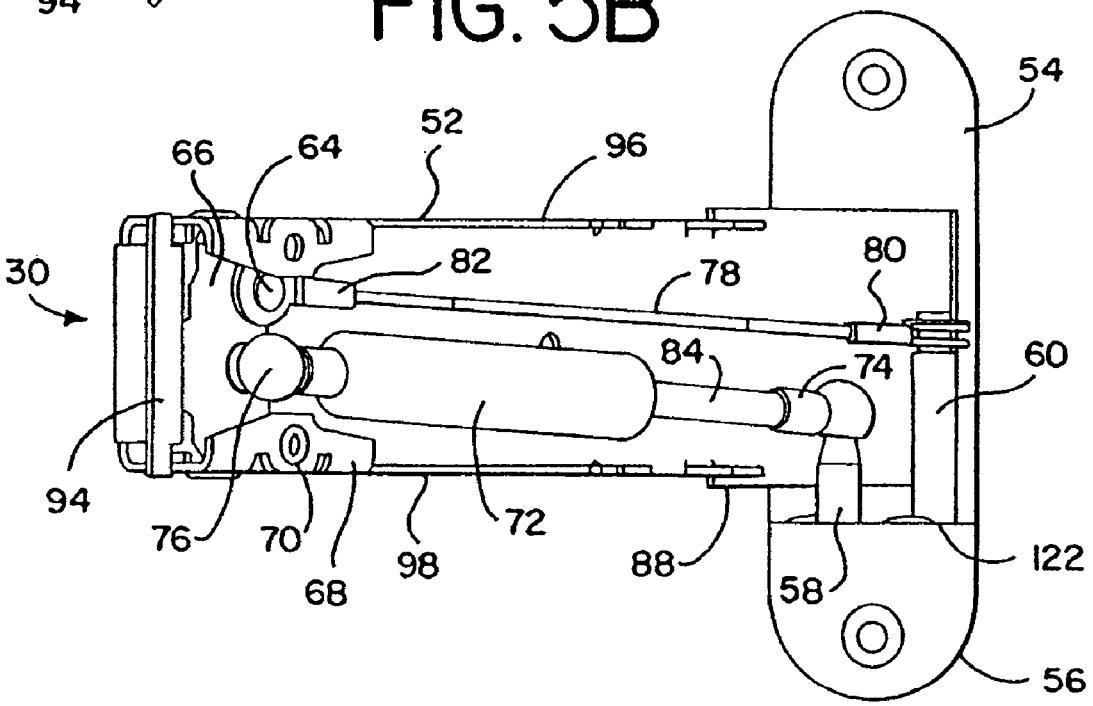
FIG. 5B is a side view of the door control assembly illustrated in FIG. 5A.

FIGS. 5A and 5B are top views and side views, respectively, of door control assembly 30 when door 22 is opened to approximately 45°. In a 45° door open position, a longitudinal axis passing through cable 78 and piston rod 84 are substantially aligned with one another. Further, both cable 78 and piston rod 84 are opposite pivot point 120 from flange 54. In this position, piston 72 begins to exert a slight opening force on mounting plate 52 and door 22.

As shown in the top view of FIG. 5A, plate 88 rotates about pivot point 120 above upper surface 122 of platform 56. Referring to FIG. 5B, in a 45° door open position, the camming action of upper and lower hinges 26 and 28 causes a slight vertical displacement of mounting plate 52. The vertical displacement of mounting plate 52 is shown by an increase in the distance between the lower surface of plate 88 and upper surface 122 of platform 56. As mounting plate 52 is vertically displaced, reciprocating arm 66 rotates about pin joint 70 to relieve torsion forces that would otherwise arise in cable 78 and piston 72.

In accordance with the illustrated embodiment of the invention, piston 72 will exert an opening force on mounting plate 52 and door 22 when the open angle of door 22 is about 90° to about 110° with respect to door frame 50. In this range of door opening movement cable 78 has crossed over center point 120 and remains taut and counterbalances the closing force exerted by piston 72. Also, piston 72 exerts an opening force on door 50. Thus, the action of cable 78 in combination with reciprocating arm 66 provides a net opening force on door 22. When door 22 is open at an angle of about 45°, the pushing force exerted on door 22 by piston 72 is substantially the same as the pulling force exerted on door 22 by cable 78. Also, a door open angle of about 45°, reciprocating arm 66 is in a substantially vertical position with respect to mounting plate 52.

Figure 6A:
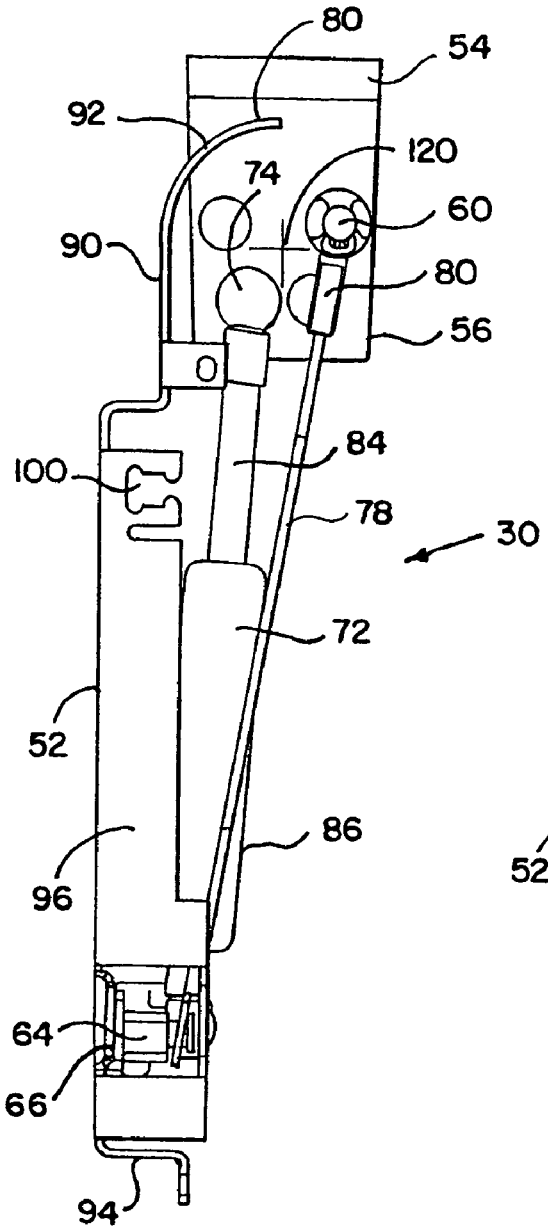
FIG. 6A is an a top view of the door control assembly illustrated in FIG. 2 at a door open angle of 90°.
Figure 6B:
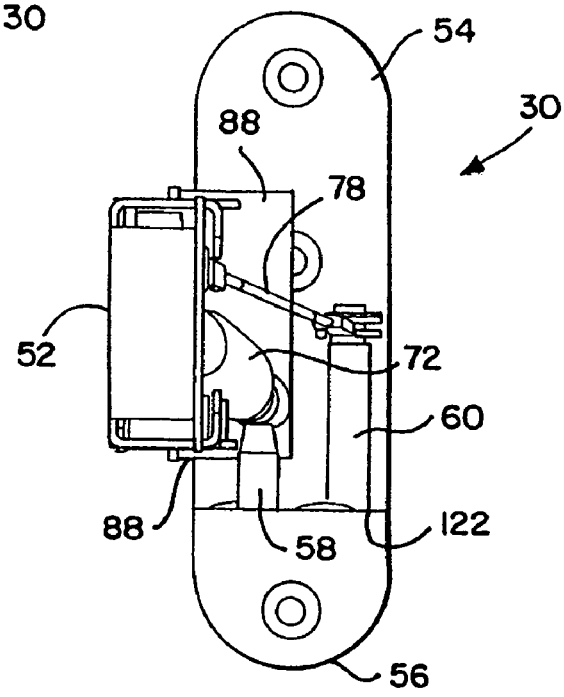
FIG. 6B is a side view of the door control assembly illustrated in FIG. 6A.

When door 22 is open at an angle of about 90° with respect to door frame 50, door control assembly 30 appears as illustrated in the top view of FIG. 6A and the side view of FIG. 6B. At a door open angle of about 90°, cable 78 resides at a greater distance from mounting plate 52 than does cylinder 72. Also, as illustrated in FIG. 6B, the lower edge of plate 88 continues to become more vertically displaced from upper surface 122 as a result of the camming action of upper and lower hinges 26 and 28. In this door open position, cable 78 continues to remain taunt and provides a pulling force on mounting plate 52 that opposes the pushing force of cylinder 72 on mounting plate 52. Also, in this position, piston rod 84 is fully extended from cylinder 86 of piston 72. Piston 72 is internally designed to be fully extended and to have a maximum stroke at a door open angle of about 90°. In this position, door control assembly 30 exerts essentially no force on door 22 and, accordingly, the net torque on door 22 is about zero.

Figure 7A:
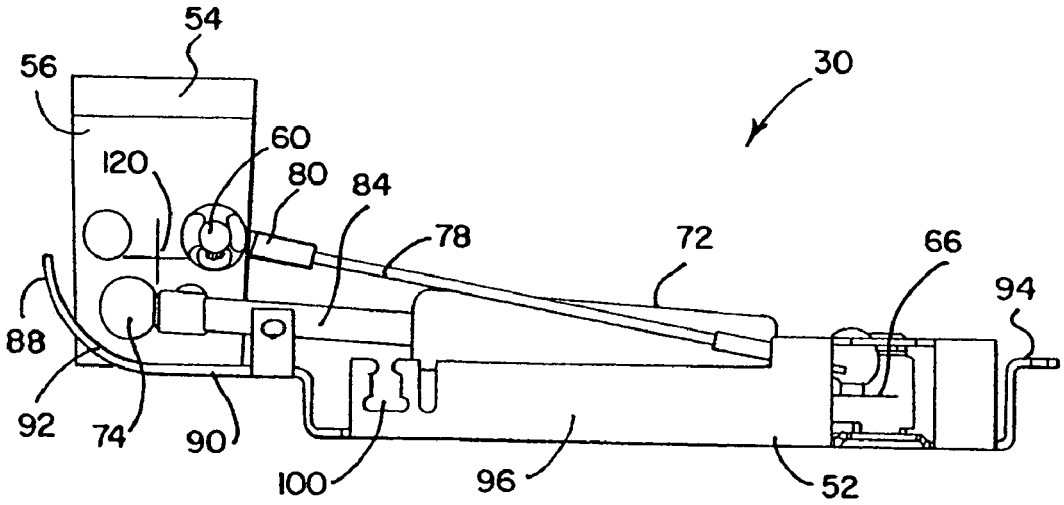
FIG. 7A is a top view of the door control assembly illustrated in FIG. 2 at a door open angle of 180°.
Figure 7B:
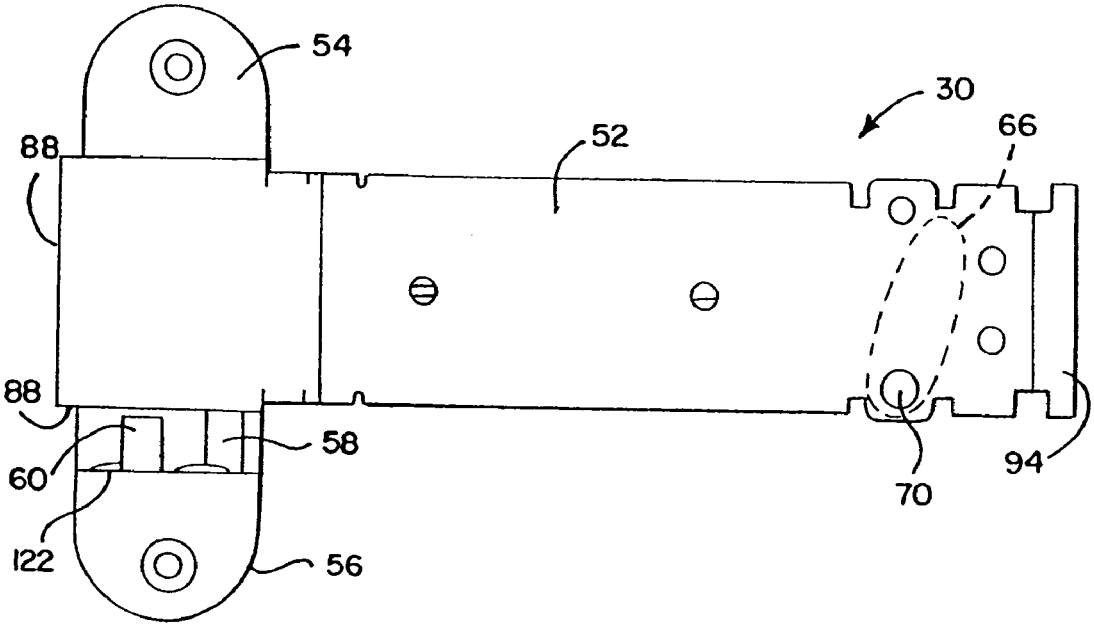
FIG. 7B is a side view of the door control assembly illustrated in FIG. 7A.

A top view and a side view of door control assembly 30 at a door open angle of about 180° are illustrated in FIGS. 7A and 7B, respectively. Door control assembly 30 and upper and lower hinges 26 and 28 are designed so as to allow door 22 to be fully opened to a 180° position with respect to door frame 50. In a fully open position, door 22 is swung completely away from door frame 50 and does not encroach within the opening defined by door frame 50. Those skilled in the art will appreciate that, with door 22 completely out of the way, bulky items can be moved into and out of refrigerated compartment 20 without interference from door 22.

As a result of the camming action of upper and lower hinges 26 and 28, door 22 reaches a maximum vertical displacement at a door open angle of about 100°. In the illustrative embodiment, door 22 is lifted about 7/16 inches relative to its fully-closed position. The vertical displacement is reflected in FIG. 7B by the vertical separation of the lower surface of plate 88 and upper surface 122 of platform 56. An opening force on the door is maintained solely by piston 72. Cable 78 is slack and does not exert any force on mounting bracket 52.

A comparison between FIGS. 7A and 7B and FIGS. 4A and 4B illustrates the relative position of components in door control assembly 30 when door 22 is fully opened and fully closed, respectively. In both a fully closed and fully opened door position, cable 78 is slack and exerts essentially no force on mounting plate 52. With respect to pivot point 120, in both a fully closed and fully opened door position, cable 78 and piston rod 84 reside on opposite sides of pivot point 120. Reciprocal arm 66 leans slightly to the right in FIG. 7B (as shown in silhouette) and slightly to the left in FIG. 4B. Reciprocal arm 66 is at its maximum rotational displacement about pin joint 70 at a fully closed and fully-opened door position.

Figure 8A:
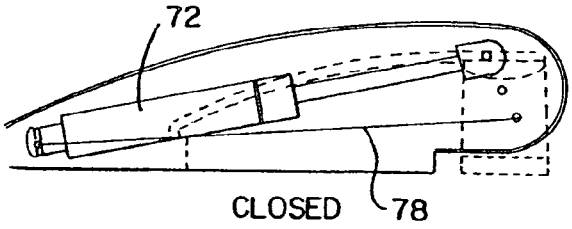
FIGS. 8A–8D are schematic diagrams of top views of the door control assembly illustrated in FIG. 2 at various door open positions.
Figure 8B:
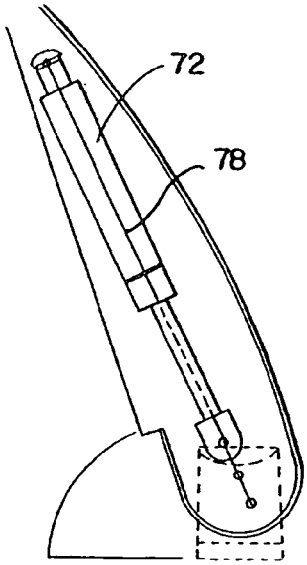
Figure 8C:
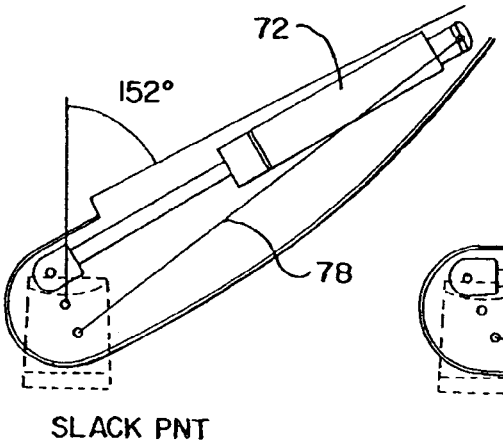
Figure 8D:
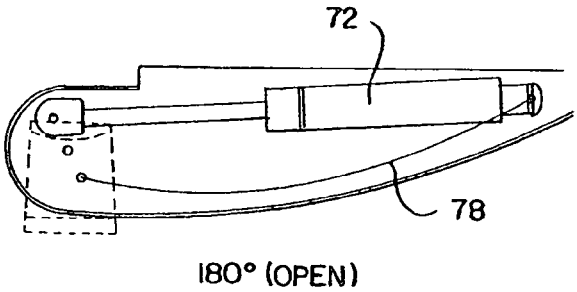

A schematic diagram of piston 72 and cable 78 is shown in four different door open positions in FIGS. 8A–8D. In FIG. 8A, piston 72 and cable 78 are shown when door 22 is fully closed. In FIG. 8B, door 22 is at a door open angle of about 45°. In FIG. 8C, door 22 is at an open angle of about 150°. In FIG. 8D, door 22 is fully open at a door open angle of about 180°. Referring to FIGS. 8A–8D, cable 78 is slack in FIG. 8A, at maximum tension in FIG. 8B, begins to go slack in FIG. 8C, and is fully slack in FIG. 8D. Correspondingly, piston 72 exerts a closing force in FIG. 8A, exerts a pushing force on door 22 that is counterbalanced by a pulling force on door 22 that is counterbalanced by a pulling force of cable 78 in FIG. 8B, passes through a point of maximum extension and again exerts an opening force on door 22 at FIG. 8C, and continues to exert an opening force in FIG. 8D. The closing torque, net torque, and opening force exerted by door control assembly 30 at various door open positions is shown below in Table I.

TABLE I

Door Closing And Opening Force Values

| Door Angle (degrees) | Closing Torque (in-lbs) | Net Torque (in-lbs) | Opening Force (lbs) |
|---|---|---|---|
| 0 | 179.0 | 179.0 | 4.97 |
| 10 | 176.8 | 176.6 | 4.91 |
| 20 | 158.7 | 158.7 | 4.41 |
| 40 | 123.8 | 123.8 | 3.44 |
| 60 | 75.2 | 75.2 | 2.09 |
| 80 | 47.2 | 47.2 | 1.31 |
| 100 | −12.5 | −12.5 | −0.35 |
| 110 | −19.2 | −6.4 | −0.18 |
| 120 | −19.2 | 18.6 | .052 |
| 130 | −19.3 | 48.7 | 1.35 |
| 180 | −21.8 | 204.8 | 5.69 |

The data presented in Table I shows that the closing torque and net torque have maximum values when the door is closed, which corresponds to a door angle of 0°. The closing torque and net torque gradually diminish as the door open angle increases to 80°. At door open angles of 100° to about 110°, the closing torque and the net torque have negative values. At door open angles of about 120° to about 180°, the closing torque continues to have a negative value but decreases in magnitude, while the net torque becomes positives and increases in value. The opening force required at the door handle is strongest at 0° door open angle and diminishes to a minima between a door open angle of about 80° and about 100°. There is essentially an auto opening force at door open angles of about 80° to about 120°. At door open angles of about 120° to about 180°, the opening force increases to a maxima at door open angles of about 145° to about 160°, then diminishes slightly at a fully open door position corresponding to a door open angle of about 180°.

Those skilled in the art will recognize that door control assembly 30 is configured to produce a precise closing force and opening force on door 22 at various door open angles. The opening force and closing force are balanced relative to one another to provide precise amounts of door open and closing assistance during the travel of door 22 from a fully closed to a fully-open position. By precisely controlling the net force applied to door 22 at various open angles, door open assistance can be generated so that a user does not have to provide all the force necessary to open door 22. Opening assistance is particularly advantageous for the relatively-large doors typically used with refrigerated compartments, such as food chilling compartments and the like. Door control assembly 30 also exerts a closing force on door 22 that assists in providing sufficient force to properly close door 22. In the illustrative embodiment described herein, door control assembly 30 generates a closing force sufficient to allow a magnetic door latch to engage door 22 and hold door 22 in a closed position within door frame 50.

In addition to generating both an opening force and a closing force, door control assembly 30 also enables door 22 to be parked in an open position. In the illustrative embodiment, door 22 can be parked at a door open angle of about 120° or greater. As indicated in Table I, the closing torque and the net torque have approximately equal magnitude but opposite directions at about 120°. Also, the opening force exerted by door control assembly 30 at a door open angle of about 120° has only a small, slightly positive value. Under this combination of applied forces, door 22 can be opened by a user to a door open angle of about 120° or greater and will remain in that position until a user exerts an opening or closing force on door 22.

The particular force values illustrated in Table I represent one embodiment of the invention. Those skilled in the art will recognize that the force values and resultant net torque vectors applied to door 22 can vary depending on, for example, the particular design characteristics of piston 72, the locations of first ball stud 58 and first post 60, the length of reciprocal arm 66, and its distance from flange 54, and the like. Accordingly, the relative force values shown in Table I can vary depending upon the particular design attributes of door control assembly 30. For example, the amount of force applied to door 22 can be increased or decreased depending upon the weight of the door or the particular location of door control assembly 30 on door 22 or the like. Further, where it is not desired that door 22 remain open under any circumstances, door control assembly 30 can be configured to apply a constant closing force on door 22.

Figure 9:
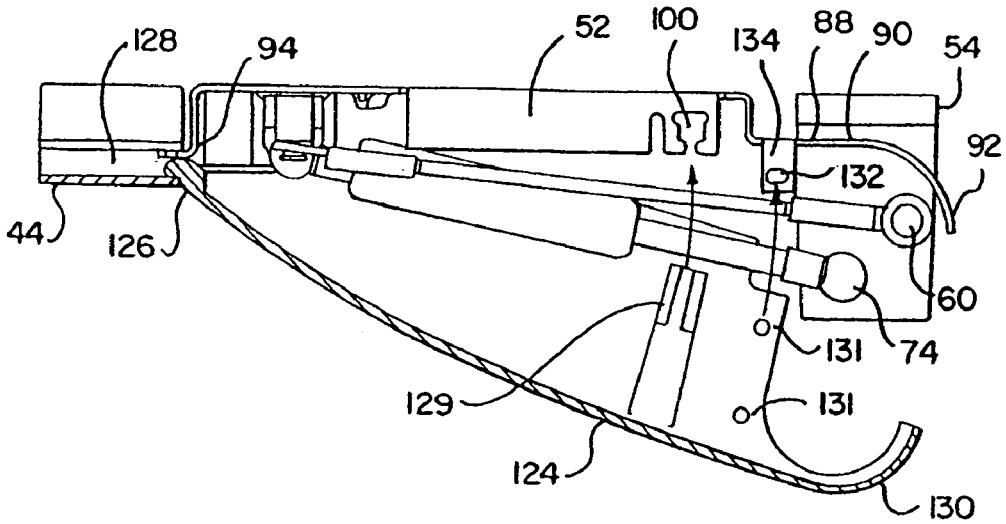
FIG. 9 is a top view of the door control assembly illustrated in FIG. 2 showing a cover arranged in accordance with a preferred embodiment of the invention.

In accordance with the illustrated embodiment of the invention, door control assembly 30 includes covering hardware and coupling features that function to both conceal the operative elements of door control assembly 30 and to present an aesthetically-pleasing exterior appearance. Shown in FIG. 9 is a top view of door control assembly 30 in which a cover 124 is in position to be coupled to mounting plate 52. Cover 124 includes a locking tab 126 that inserts into a channel 128 in handle extension 44. Locking tab 94 of mounting plate 52 also inserts channel 128 adjacent to locking tab 126 of cover 124. An attachment pin 129 of cover 124 inserts into receiving channel 100 of mounting plate 52. Cover 124 is attached to mounting plate 52 by first inserting locking tab 126 into channel 128 then rotating cover 124 in place as indicated by the directional arrows shown in FIG. 9. Cover 124 includes a canopy 130 that cantilevers over flange 54 and cooperates with curved section 92 and flat section 90 of plate 88 to enclose first ball stud 58 and first post 60.

FIG. 9 also shows pin openings 131 in cover 124. When cover 124 is rotated and snapped into position against mounting plate 52, the most proximate pin opening aligns with an opening 132 in a tab 134.

After attaching cover 124 to mounting plate 52, a cap 136 is positioned in a seat formed by a combination of canopy 130 and plate 88. As illustrated in the front view of FIG. 10, cap 136 snaps into place at a position overlying first ball stud 58 and first post 60. In its assembled position, cover 124 forms a continuous span with handle extension 44.

Figure 10:
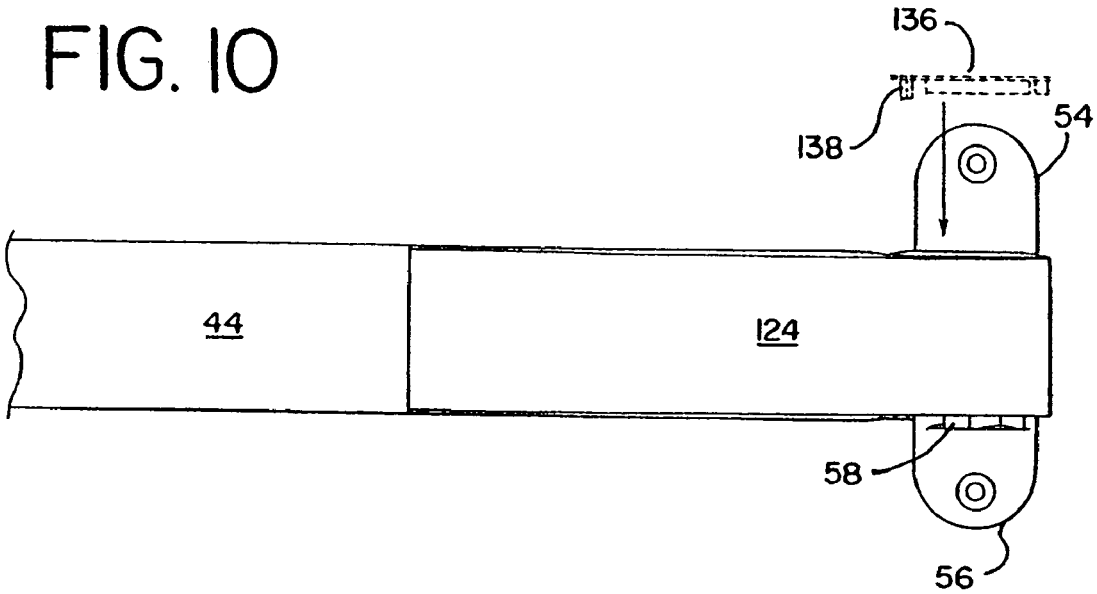
FIG. 10 is a side view of the door control assembly illustrated in FIG. 9.

In FIG. 10, cap 136 includes two locking pins 138 that insert into pin openings 131 and opening 132 (shown in FIG. 9). The locking pin that inserts through opening 132 holds cover 124 in place at flange 54.

Figure 12:
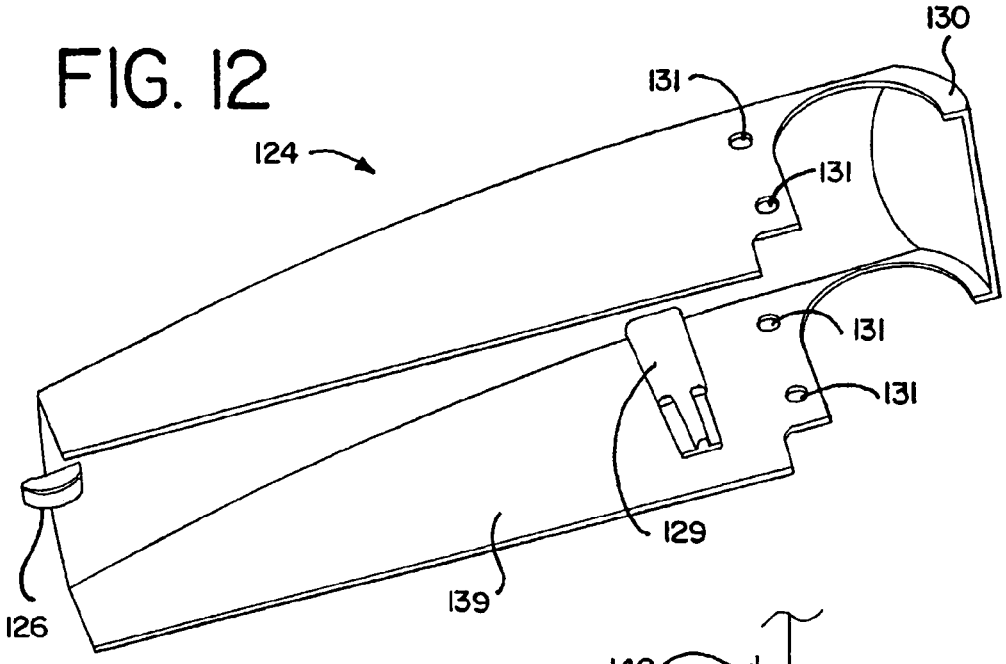
FIG. 12 is a perspective view of the cover illustrated in FIG. 11.

FIG. 12 is a perspective view of cover 124 illustrating the design features of the inside surface. In the illustrated embodiment, attachment pin 129 is molded into an inner surface of a side panel 139 of cover 124. Also, another attachment pin (not shown) resides on the inner surface of the side panel opposite side panel 139.

Figure 11:
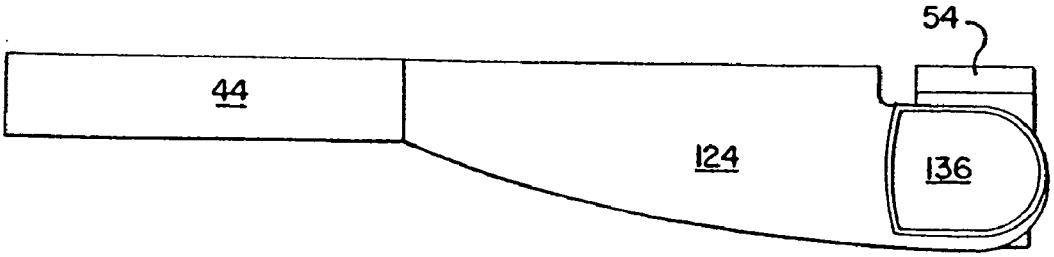
FIG. 11 is a top view of the door control assembly illustrated in FIG. 10.

A top view of the enclosed door control assembly is illustrated in FIG. 11. With cap 136 in place, the operative components of door control assembly 30 are substantially concealed in an aesthetically-pleasing enclosure. Cover 124 and cap 136 are configured so as to allow the full range of motion of door control assembly 30 without contact to any portion of flange 54.

Figure 13:
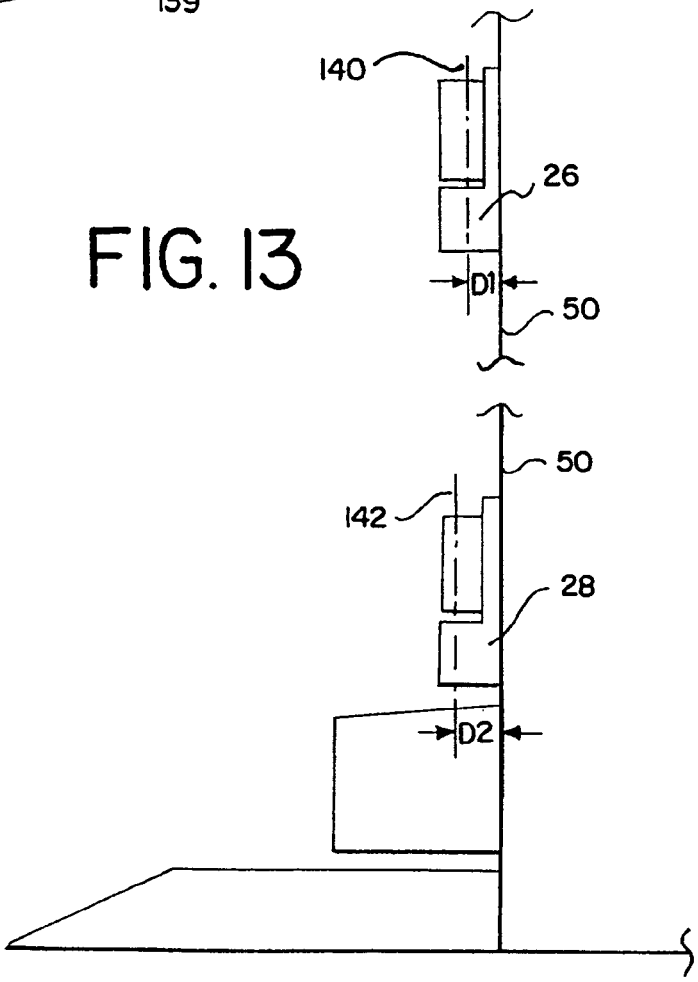
FIG. 13 is a cut-away side view of the refrigerated compartment illustrated in FIG. 1 showing the hinges in FIG. 1 arranged in accordance with one embodiment of the invention.

FIG. 13 shows a partial side view of portions of door frame 58 where upper and lower hinges 26 and 28 are mounted. Upper door hinge 26 has a pivot axis 140 and lower door hinge 28 has a pivot axis 142. Pivot axis 140 of upper door hinge 26 is spaced away from door frame 50 by a distance "D1," and pivot axis 142 of lower hinge 28 is spaced away from door frame 50 by a distance "D2." In accordance with one embodiment of the invention, upper and lower door hinges 26 and 28 are oblique hinges, such that distance D2 is greater than distance D1. Hinge pins (not shown) are inserted in upper and lower hinges 26 and 28 on pivot axis 140 and 142, respectively. By displacing the hinge pin of lower door hinge 28 at a greater door frame 50 than the hinge pin of upper door hinge 26, upper and lower hinges 26 and 28 contribute to the opening and closing force applied to door 22 by door control assembly 30.

Thus, it is apparent that there has been described in accordance with the preferred embodiment of the invention a door control assembly, door, and hinge set that fully meet the advantages set forth above. Although the invention has been described and illustrated with reference to specific illustrative embodiments thereof, it is not intended that the invention be limited to those illustrative embodiments. Those skilled in the art will recognize that variations and modifications can be made without departing from the spirit of the invention. For example, a wide variety of materials can be used to construct the various components of the door control assembly, such as sheet metals, plastics, metallized plastics, and the like. Further, the outward shape and location of the door control assembly can vary depending upon factors, such as the size and weight of the door. It is therefore intended to include within the invention all such variations and modifications that fall within the scope of the appended claims and equivalents thereof.

The invention claimed is:

1. A door control assembly for a door closing an opening into a refrigerated compartment comprising:

(a) a mounting plate configured to attach to the door;

(b) a flange configured to attach to a wall of the refrigerated compartment, the flange having a platform extending away from the wall;

(c) a first ball stud and a first post extending from the platform;

(d) a reciprocating arm coupled to the mounting plate;

(e) a second ball stud and a second post extending from the reciprocating arm and oriented generally perpendicular to the reciprocating arm;

(f) a control mechanism pivotally engaged with the first ball stud at a first end and with the second ball stud at a second end; and (g) a cable coupled to the first post at a first end and to the second post at a second end.

2. The door control assembly of claim 1 wherein the mounting plate further comprises upper and lower brackets each having receiving channels therein and a plate extending away from the door, the plate having a flat portion adjacent to the wall and a curved section partially surrounding the first ball stud and first post.

3. The door control assembly of claim 2 further comprising a cover having coupling members that engage the receiving channels of the mounting plate and a curved canopy at a first end that mates with the curved section of the plate to form a casing surrounding the first ball stud and the first post.

4. The door control assembly of claim 3 further comprising a cap coupled to an upper edge of the casing.

5. The door control assembly of claim 3 wherein the cover further comprises a locking tab at a second end configured to couple to a handle extension on the door.

6. The door control assembly of claim 5 wherein the mounting plate further comprises a mating member configured to couple with the handle extension.

7. The door control assembly of claim 2 wherein the reciprocating arm is coupled to the lower bracket by a pinned joint at a lower end of the reciprocating arm, and wherein the reciprocating arm pivots about the pinned joint.

8. The door control assembly of claim 1 wherein the door control assembly is configured to exert an opening force when the door is open at an angle with respect to the wall of between about 90 degrees and about 110 degrees, and wherein the door control assembly is configured to exert a closing force when the door open angle is less than about 45 degrees.

9. The door control assembly of claim 1 wherein the door control assembly is configured to park the door in an open position.

10. The door control assembly of claim 9 wherein the open position is at a door open angle of about 120 degrees or greater.

11. The door control assembly of claim 1 wherein the control mechanism comprises a fluidic control mechanism.

12. The door control assembly of claim 11 wherein the fluidic control mechanism comprises an assembly selected from the group consisting of pneumatic assemblies and hydraulic assemblies.

13. The door control assembly of claim 12 wherein the fluidic control mechanism comprises a cylinder and gas piston.

14. In combination, a door closing an opening in a wall of a refrigerated compartment, a hinge set, and a door control assembly, the door control assembly comprising:

(a) a mounting plate attached to the door;

(b) a flange attached to a door frame of the refrigerated compartment;

(c) a door control mechanism having a first end attached to the flange and a second end attached to the mounting plate; and (d) a cover attached to the mounting plate and overlying the first end of the door control mechanism, the cover having a canopy cantilevered over the flange and enclosing the first end of the door control mechanism against the wall.

15. The combination of claim 14 wherein the mounting plate further comprises a curved section positioned between the wall and the first end of the door control mechanism, the curved section cooperating with the canopy to enclose the first end of the door control mechanism.

16. The combination of claim 15 further comprising a cap coupled to an upper edge of the curved section and the canopy and positioned above the first end of the door control mechanism.

17. The combination of claim 14 wherein the door control mechanism comprises:

(a) a reciprocating arm mounted to the mounting plate by a pinned joint;

(b) a fluidic control mechanism coupled to the reciprocating arm; and (b) a cable coupled to the reciprocating arm.

18. The combination of claim 17 wherein the door control assembly further comprises:

(a) a first ball stud and a first post extending from the flange; and (b) a second ball stud and a second post extending substantially perpendicularly from the arm, wherein the fluidic control mechanism is coupled to the first ball stud at a first end by a first socket and to the second ball stud at a second end by a second socket, and wherein the cable is coupled to the first post at a first end and to the second post at a second end.

19. The combination of claim 14 wherein the door control assembly is configured to apply an opening and a closing force to the door, wherein the opening force is exerted when the door is open at an angle with respect to the wall of between about 90 degrees and about 120 degrees, and wherein the closing force is exerted when the door open angle is less than about 45 degrees.

20. The combination of claim 19 wherein the door control assembly is configured to park the door in an open position.

21. The combination of claim 20 wherein the open position is at an open angle of about 120 degrees or greater with respect to the wall.

22. The combination of claim 19 further comprising:

(a) an upper door hinge having a hinge pin; and (b) a lower door hinge having a hinge pin, wherein the door control assembly is positioned between the upper and lower door hinges, wherein the hinge pin of the lower hinge is displaced away from the wall a greater distance than the pin of the upper hinge, and wherein the upper and lower hinges contribute to the opening and a closing force applied to the door.

23. The combination of claim 14 further comprising:

(a) a door handle; and (b) a handle extension coupled to the door handle at a first end and extending across the door and coupled to the cover at a second end.

24. A concealed middle position door control assembly comprising:

(a) a door control mechanism for applying opening and closing force to a door;

(b) a mounting plate positioned behind the control mechanism, the mounting plate a having a flat section and a curved section cantilevered away from the flat section; and (c) a cover overlying the control mechanism, wherein the cover has a canopy at a first end that cooperates with the curved section to enclose the control mechanism, and wherein the cover is coupled to the mounting plate at a second end.

25. The door control assembly of claim 24 further comprising a handle extension coupled to the second end of the cover.

26. The door control assembly of claim 25 wherein a locking tab at the second end of the cover inserts into a channel in the handle extension.

27. The door control assembly of claim 24 further comprising a flange wherein a lower portion of the flange includes a platform that supports attachments for one end of the door control mechanism.

28. The door control assembly of claim 27 wherein the door control mechanism comprises a fluidic control mechanism, and wherein the door control assembly further comprises:

(a) a first ball stud and a first post protruding from the platform in a first direction;

(b) an arm pivotally mounted to the mounting plate;

(c) a second ball stud and a second post protruding from the arm in a second direction, wherein the second direction is generally perpendicular to the first direction; and (d) a cable, wherein the fluidic control mechanism is coupled to the first ball stud at a first end and to the second ball stud at a second end, and wherein the cable is coupled to the first post at a first end and to the second post at a second end.

29. The door control assembly of claim 28 wherein the fluidic control mechanism is selected from the group consisting of a pneumatic assembly and a hydraulic assembly.

30. The door control assembly of claim 29 wherein the fluidic control mechanism comprises a cylinder and gas piston.

31. The door control assembly of claim 28 further comprising a cap coupled to an upper edge of the curved section and to an upper edge of the canopy and positioned above the first ball stud and the first post, and wherein the cap includes pins that inserts through openings in the mounting plate and the cover to secure the canopy to the curved section.

32. A refrigerated compartment comprising:

(a) a wall;

(b) door positioned within a door frame and closing an opening in the wall;

(c) an upper door hinge having a hinge pin displaced a first distance away from the door frame;

(d) a lower door hinge having a hinge pin displaced a second distance away from the door frame, wherein the second distance is greater than the first distance;

(e) a door control mechanism having a first end attached to the door frame between the upper and lower hinges and a second end attached to a midsection of the door and, wherein the door control mechanism is configured to exert an opening force when the door is opened by a user and to exert a closing force when the door is closed by a user; and (f) a cover that conceals the door control mechanism.

33. The combination of claim 32 wherein the opening force is exerted when an angle that the door is open with respect to the wall is between about 90 degree and about 120 degrees, and wherein the closing force is exerted when the door open angle is less than about 45 degrees.

34. A door control assembly configured to exert an opening and a closing force on a door positioned within a door frame, the door control assembly comprising:

(a) a reciprocating arm configured to couple to the door;

(b) a flange configured to attach to the door frame;

(c) a fluidic control mechanism coupled to the flange at a first end and to the reciprocating arm at a second end; and (d) a cable coupled to the flange at a first end and to the reciprocating arm at a second end.

35. The door control assembly of claim 34 further comprising:

(a) a first ball stud and a first post extending substantially vertically from a platform at a lower end of the flange; and (b) a second ball stud and a second post extending substantially perpendicularly from the arm, wherein the fluidic control mechanism is coupled to the first ball stud at a first end by a first socket and to the second ball stud at a second end by a second socket, and wherein the cable is coupled to the first post at a first end and to the second post at a second end.

36. The door control assembly of claim 35 wherein the fluidic control mechanism comprises an assembly selected from the group consisting of pneumatic assemblies and hydraulic assemblies.

37. The door control assembly of claim 36 wherein the fluidic control mechanism comprises a cylinder and gas piston.

38. The door control assembly of claim 35 wherein the platform is configured such that a pivot point of the door passes through the platform, and wherein the first ball stud is configured to be mounted to the platform opposite the pivot point from the door jamb, and wherein the first post is configured to be mounted to the platform between the door frame and the pivot point.

39. The door control assembly of claim 38 wherein the fluidic control mechanism comprises a cylinder housing a piston, and wherein a piston rod is attached to the piston and protrudes from the cylinder.

40. The door control assembly of claim 39 wherein a longitudinal axis of the cable and the piston rod are substantially aligned with each other when the door is open at an angle of about 45 degrees with respect to the wall.

41. The door control assembly of claim 40 wherein the fluidic control mechanism is configured to exert a pushing force on the door and the cable is configured to exert a pulling force on the door, and wherein the pushing force and the pulling force are substantially the same.

42. The door control assembly of claim 41 wherein the reciprocating arm is in a substantially vertical position.

43. The door control assembly of claim 38 wherein the cable is configured such that when a door open angle is less that about 45 degrees, a plane passing vertically through the cable resides at a location between the pivot point and the door frame, and the fluidic control mechanism and the cable exert a net closing force on the door.

44. The door control assembly of claim 38 wherein the cable is configures such that when the door is open at an angle with respect to the wall that exceeds about 45 degrees, a plane passing vertically through the cable resides at a location opposite the pivot point from the door frame and the fluidic control mechanism and the cable exerts a net opening force on the door.

45. The door control assembly of claim 44 wherein the cable is configures such that the fluidic control mechanism and the cable exert a net opening force on the door when the door open angle is between about 90 degrees and about 120 degrees.

46. The door control assembly of claim 45 wherein when the door open angle exceeds about 150 degrees, the cable becomes slack and does not exert force on either the door or the door frame.

* * * * *

UNITED STATES PATENT AND TRADEMARK OFFICE

CERTIFICATE OF CORRECTION

PATENT NO. : 7,146,766 B2
APPLICATION NO. : 10/802161
DATED : December 12, 2006
INVENTOR(S) : Burl Finkelstein It is certified that error appears in the above-identified patent and that said Letters Patent is hereby corrected as shown below:

Column 11, claim 17, line 24, before "a cable coupled" replace "(b)" with --(c)--.

Column 12, claim 24, line 2, after "the mounting pate" delete "a".

Column 14, claim 44, line 23, before "such that when" replace "configures" with --configured--.

Column 14, claim 45, line 30, before "such that the" replace "configures" with --configured--.

Signed and Sealed this

Thirtieth Day of March, 2010

David J. Kappos

David J. Kappos
*Director of the United States Patent and Trademark Office*